US010295314B2

(12) United States Patent
Anderson

(10) Patent No.: US 10,295,314 B2
(45) Date of Patent: May 21, 2019

(54) MOVEABLE TARGET CARRIER SYSTEM

(71) Applicant: Action Target Inc., Provo, UT (US)

(72) Inventor: Devin Anderson, Orem, UT (US)

(73) Assignee: Action Target Inc., Provo, UT (US)

( * ) Notice: Subject to any disclaimer, the term of this patent is extended or adjusted under 35 U.S.C. 154(b) by 0 days.

(21) Appl. No.: 15/404,580

(22) Filed: Jan. 12, 2017

(65) Prior Publication Data

US 2017/0205207 A1 Jul. 20, 2017

Related U.S. Application Data

(60) Provisional application No. 62/279,411, filed on Jan. 15, 2016.

(51) Int. Cl.

| | |
|---|---|
| ***F41J 7/02*** | (2006.01) |
| ***F41J 9/10*** | (2006.01) |
| ***F41J 1/10*** | (2006.01) |
| ***F41J 11/02*** | (2009.01) |

(52) U.S. Cl.
CPC . *F41J 7/02* (2013.01); *F41J 1/10* (2013.01); *F41J 9/10* (2013.01); *F41J 11/02* (2013.01)

(58) Field of Classification Search
CPC ..... F41J 7/02; F41J 7/00
USPC ..... 273/359, 360, 403–408; 73/826
See application file for complete search history.

(56) References Cited

U.S. PATENT DOCUMENTS

| | | | |
|---|---|---|---|
| 157,335 | A | 12/1874 | Lyon |
| 429,942 | A | 6/1890 | McBride |
| 483,060 | A | 9/1892 | Holm |
| 570,820 | A | 11/1896 | Scratton |
| 631,175 | A | 8/1899 | Parnall |
| 840,610 | A | 1/1907 | Easdale |
| 879,670 | A | 2/1908 | Petry |
| 937,733 | A | 10/1909 | Worrell |
| 950,101 | A | 2/1910 | Green |
| 960,085 | A | 5/1910 | Giles |
| 960,892 | A | 6/1910 | Gates |
| 1,036,879 | A | 8/1912 | Miner |
| 1,207,456 | A | 12/1916 | Whelan |
| 1,348,283 | A | 8/1920 | Koehl |
| 1,424,632 | A | 8/1922 | Fenton |
| 1,517,461 | A | 8/1924 | Robinson |
| 1,540,802 | A | 6/1925 | Ordway |
| 1,543,605 | A | 6/1925 | Gavard |
| 1,559,171 | A | 10/1925 | Knowles |

(Continued)

FOREIGN PATENT DOCUMENTS

| | | |
|---|---|---|
| CA | 2100631 | 2/1994 |
| GB | 2136932 | 9/1984 |
| GB | 2 187 270 | 9/1987 |

OTHER PUBLICATIONS

Caswell International Corp., Product Literature, Copyright 2002.

(Continued)

*Primary Examiner* — Mark S Graham
(74) *Attorney, Agent, or Firm* — Durham Jone & Pinegar; Randall B. Bateman

(57) ABSTRACT

The present invention relates to equipment for target ranges, and more specifically, to moveable track-mounted target carriers having means for adjusting suspension or cushioning. The present disclosure also relates to target carriers with cable tension adjusting means which can be accessed without disturbing or disassembling the target carrier.

26 Claims, 9 Drawing Sheets

(56) References Cited

U.S. PATENT DOCUMENTS 1,657,931 A 7/1926 Krantz
1,640,954 A 8/1927 Mach
1,738,874 A 12/1929 Domingo
1,831,289 A 11/1931 Dally
2,048,155 A 1/1935 Armantrout
2,008,359 A 7/1935 Lamb
2,039,552 A 5/1936 Reynolds
2,085,933 A 7/1937 Vaughan
2,104,171 A 1/1938 Schwerin
2,179,471 A 11/1939 Lee
2,284,510 A 5/1942 Cates
2,290,297 A 7/1942 Smith
2,344,829 A * 3/1944 McAvoy ..... F41J 7/02 104/173.1
2,372,111 A 3/1945 Norberg
2,538,118 A 6/1949 Miller
2,494,210 A 1/1950 Robinson
2,535,280 A 12/1950 Gartrell
2,586,958 A 2/1952 Keller
2,587,042 A 2/1952 Haiselup
2,613,934 A 10/1952 Tabler
2,706,634 A 4/1955 Van Valkenburg
2,809,836 A 10/1957 Omar Musser Clair
2,819,903 A 1/1958 Saunders
2,838,309 A 6/1958 Merz et al.
2,905,469 A 9/1959 Taylor
2,967,712 A 1/1961 Breitenfeldt
3,014,725 A 12/1961 Lewis
3,032,808 A 5/1962 Fleming
3,064,976 A 11/1962 Kuhn
3,087,701 A 4/1963 Wallace
3,103,362 A 9/1963 Elofson
3,113,773 A 12/1963 Ripepe
3,140,874 A 7/1964 Jensen et al.
3,233,904 A 2/1966 Gillam et al.
3,348,843 A 10/1967 Stanley
3,363,900 A 1/1968 Cadle
3,385,405 A 5/1968 Cullen
3,392,980 A 7/1968 Ortega
3,422,538 A 1/1969 Panissidi
3,471,153 A 10/1969 Baumler
3,510,133 A 5/1970 Gretzky
3,515,388 A 6/1970 Zachmeier
3,540,729 A 11/1970 Rahberger
3,601,353 A 8/1971 Dale
3,614,102 A 10/1971 Nikoden, Sr.
3,720,411 A 3/1973 Vogelaere
3,802,098 A 4/1974 Sampson et al.
3,914,879 A 10/1975 Taylor, III
3,992,007 A 11/1976 Seeman
4,072,313 A 2/1978 Murso et al.
4,076,247 A 2/1978 Kim et al.
4,084,299 A 4/1978 Noda
4,086,711 A 5/1978 Gammarino et al.
4,177,835 A 12/1979 Paley
4,205,847 A 6/1980 Steiger et al.
4,228,569 A 10/1980 Snyder
4,232,867 A 11/1980 Tate, Sr.
4,288,080 A 9/1981 Laporte et al.
4,294,452 A 10/1981 Schlotter et al.
4,340,370 A 7/1982 Marshall et al.
4,361,330 A 11/1982 Scharer
4,395,045 A 7/1983 Baer
4,440,399 A 4/1984 Smith
4,501,427 A 2/1985 Payne
4,506,416 A 3/1985 Ohminato et al.
4,540,182 A 9/1985 Clement
4,546,984 A 10/1985 Towle et al.
4,614,345 A 9/1986 Doughty
4,657,261 A 4/1987 Saunders
4,691,925 A 9/1987 Scholem
4,706,963 A 11/1987 Geuss
4,726,593 A 2/1988 Wade
4,739,996 A 4/1988 Vedder
4,743,032 A 5/1988 Summers et al.
4,807,888 A 2/1989 Pidde
4,844,476 A 7/1989 Becker
4,890,847 A 1/1990 Cartee et al.
4,898,391 A 2/1990 Kelly et al.
4,911,453 A 3/1990 Essex et al.
4,913,389 A 4/1990 McCracken
4,953,875 A 9/1990 Sudit
4,979,752 A 12/1990 Fosseen
5,054,723 A 10/1991 Arnold
5,145,133 A 9/1992 France
5,263,721 A 11/1993 Lowrance
5,316,479 A 5/1994 Wong et al.
5,324,043 A 6/1994 Estrella
5,346,226 A 9/1994 Block
5,350,180 A 9/1994 Acock
5,352,170 A 10/1994 Condo et al.
5,361,455 A 11/1994 Kiefer
5,433,451 A 7/1995 De Vries
5,598,996 A 2/1997 Rath
5,605,335 A 2/1997 Simpson
5,621,950 A 4/1997 White
5,636,995 A 6/1997 Sharpe, III et al.
5,641,288 A 6/1997 Zaenglein, Jr.
5,648,794 A 7/1997 Jelsma et al.
5,649,706 A 7/1997 Treat, Jr. et al.
5,676,378 A 10/1997 West
5,695,196 A 12/1997 Yanosky
5,765,832 A 6/1998 Huff
5,802,460 A 9/1998 Parvulescu et al.
5,829,753 A 11/1998 Wiser
5,865,439 A 2/1999 Marcuson
5,906,552 A 5/1999 Padilla
5,907,930 A 6/1999 Ricco
5,934,678 A 8/1999 Theissen et al.
5,947,477 A 9/1999 Turnipseed
5,950,283 A 9/1999 Sato
5,963,624 A 10/1999 Pope
5,967,522 A * 10/1999 Corcoran ..... F41J 7/02 273/406
5,967,523 A 10/1999 Brownlee
5,988,645 A 11/1999 Downing
6,018,847 A 2/2000 Lu
6,109,614 A 8/2000 Ciarcia
6,223,029 B1 4/2001 Stenman et al.
6,230,214 B1 5/2001 Liukkonen et al.
6,283,756 B1 9/2001 Danckwerth et al.
6,289,213 B1 9/2001 Flint et al.
6,308,062 B1 10/2001 Chien et al.
6,322,444 B1 11/2001 Matsui et al.
6,325,376 B1 12/2001 Elliott et al.
6,328,651 B1 12/2001 Lebensfeld et al.
6,332,243 B1 12/2001 Kim
6,398,215 B1 6/2002 Carroll
6,463,299 B1 10/2002 Macor
6,478,301 B1 11/2002 Witmeyer
6,502,820 B2 1/2003 Slifko
6,543,778 B2 4/2003 Baker
6,575,753 B2 6/2003 Rosa et al.
6,679,795 B2 1/2004 Ouimette et al.
6,718,596 B2 4/2004 Kohlstrand et al.
6,728,546 B1 4/2004 Peterson et al.
RE38,540 E * 6/2004 Bateman ..... F41J 9/02 273/406
6,761,357 B2 6/2004 Witt
6,808,177 B2 10/2004 Dehart
6,896,267 B1 5/2005 Le Anna
6,994,347 B2 2/2006 Tessel et al.
7,134,977 B2 11/2006 Campbell et al.
7,201,376 B2 4/2007 Kuosa
7,823,466 B2 * 11/2010 Glass ..... G01L 5/103 73/826
7,914,004 B2 * 3/2011 Wright ..... F41J 7/06 273/391
8,006,981 B2 * 8/2011 Gibson ..... F41J 9/02 273/359
8,162,319 B2 4/2012 Stincelli et al.
8,579,294 B2 11/2013 Wright et al.
8,806,952 B1 * 8/2014 Glass ..... A63B 61/02 177/232

(56) References Cited

U.S. PATENT DOCUMENTS

| | | | | |
|---|---|---|---|---|
| 9,157,706 | B2 * | 10/2015 | Shea | F41J 7/06 |
| 2003/0034613 | A1 | 2/2003 | Tisdell | |
| 2006/0284380 | A1 | 12/2006 | Casas | |
| 2006/0290063 | A1 | 12/2006 | Hagar | |
| 2006/0290064 | A1 | 12/2006 | Hagar | |
| 2007/0234800 | A1 * | 10/2007 | Stout | G01F 23/0023 73/314 |
| 2008/0047365 | A1 * | 2/2008 | Hsieh | F16G 11/12 73/862.392 |
| 2011/0031695 | A1 | 2/2011 | Gibson | |
| 2012/0274028 | A1 | 11/2012 | Sudbeck et al. | |

OTHER PUBLICATIONS

Duelatron, Product Literature 1995.
Law Enforcement Targets, Inc., Product Literature, Jul. 8, 2003.
Law Enforcement Targets, Inc., Product Literature, Oct. 12, 2004.
Law Enforcement Targets, Inc., Product Literature, Jun. 26, 2007.
Metal Spinning Target, Inc., Dueling Trees, Jul. 8, 2003.
Mike Gibson Manufacturing, Dueling Tree, Jul. 8, 2003.
Outwest Mfg. Products, Product Literature, Jul. 8, 2003.
Porta Target, Product Literature, Circa 2000.
Shootrite, Tactical Training Target, published prior to Apr. 4, 2005.

* cited by examiner

MOVEABLE TARGET CARRIER SYSTEM

FIELD OF INVENTION

The present invention relates to equipment for target ranges, and more specifically, to moveable track-mounted target carriers having means for adjusting suspension for the drive cable used with the carrier.

BACKGROUND

In shooting ranges, shooters may wish to fire at a target that is located a set distance away from the shooter. Range distance markings are often supplied, so that a shooter can practice firing at a target located (for example) exactly 10, 20, or 30 yards away, as desired. In some scenarios, a shooter may practice firing at a rapidly-approaching target, simulating an attack, while other scenarios include the target moving laterally across the shooter's field of vision. In other training exercises, the target may be moved forwards or backwards at different speeds, simulating an advance or retreat. In other applications, a shooter may wish to bring the target carrier to within arm's length, in order to remove a badly-perforated paper target and attach a fresh one in its place, or to measure the distance between shots in a grouping.

Because walking downrange in order to adjust target placement or movement is extremely dangerous, a number of means of mechanically moving a target in a linear fashion, towards and away from a shooter or laterally across the shooter's field of vision, have been developed. Most indoor shooting ranges today use a moveable target track, located above each lane of the range. Outdoor ranges often employ targets that move from side to side, or down a long track—in such cases, the target-moving mechanisms are often located behind a concrete or other bullet-proof, low wall, while the target itself can be seen over the wall. When a shooter wishes to move the target, he or she can press a toggle connected to at least one motor.

When activated, the motor typically pulls on the appropriate side of a doubled cable, thus moving a target carrier releasably attached to that cable in a direction relative to the shooter. The motor may either be mounted at one (or both) ends of the lane or outdoor track, or may be within the target carrier itself. Although target carriers which do not employ cables exist, such devices may be slower than cable-driven ones, and often contain more electronic and mechanical parts which must be serviced to prevent electrical arcing between brushes and conductor strips.

Target holders attached to the target carrier are typically capable of holding a variety of different types and sizes of target, including paper, cardboard and steel targets, as well as longer or shorter targets for kneeling or standing shooters, bull's eye round targets, or silhouette targets. Targets may be attached with clips, clamps, screws, and the like, and may themselves be pivotable or stationary relative to the target carrier.

As the ability to provide a movable (or moving) target is highly desirable, such trolleys or carriages often see a great deal of use, and thus range owners prefer lightweight systems which require less power to run and which may place less strain on ceiling supports. But because bullets may ricochet from other parts of the range and strike the target carrier or cable, the entire system must be very robust. It is beneficial if the target carrier has some degree of suspension—that is, it starts and stops smoothly when the motor is engaged. Further, servicing a target carrier—especially one stuck in the middle of the range—can typically only be done after closing or when the rest of the range is shut down, due to the danger of entering a range while shooters are active, so it is beneficial if the target carrier requires very little servicing.

One of the major reasons that a target carrier must be serviced is poor cable tension. Target retrievers should generally be kept at a tautness of between about 20 and 80 lbs, as required by the particular range and the targets being moved. When cables are loose, the movement of the target may become particularly jerky and hard to control with any level of precision. Moreover, loose cables may cause target carriers to jump their tracks entirely, or slip from the motor pulleys. The cable may become tangled or looped around objects, or may rub against rough surfaces thus causing wear on either the cable or the surface. Cables may stretch over time, and keeping cables tight enough is an ongoing concern. Cables which are too tight, however, put unwanted strain on motors, target carriers, and other parts.

Another difficulty in adjusting cable tension is that target carriers or portions of target carriers must typically be removed from the cable before the cable can be adjusted. This can be an involved process best done by trained maintenance personnel.

One such means of addressing these problems is U.S. Pat. No. 3,614,102 to J. Nikoden, Sr. A first cable has one end spooled clockwise on a rotatable take-up drum which moves laterally about its central axis on a threaded shaft as the drum rotates. The opposite end of the cable is connected to a target carrier, providing motive force in one direction along a track and one conductor for power at the carrier. A second cable has one end spooled counterclockwise on the rotatable take-up drum and the opposite end connected to the target carrier, thus providing motive force in a direction opposite that provided by the first cable. The pitch of the threads on the shaft is equal to the diameter of the cables. One of the cables wraps around an idler pulley at the end of the track opposite the take-up spool mechanism. Such a design is rather complex, requires frequent lubrication of the threaded shaft, and has no means of quickly determining cable tension providing suspension.

Still another design used to provide linear movement to a carrier utilizes a target carriage which is pulled along the track by a steel puller cable, takeup pulley, and drive motor arrangement. Such a target system design is depicted in U.S. Pat. No. 4,889,346 to Donald M. Destry, et al.

While such devices are functional, there is a need for a simple, reliable, and robust new system for providing linear movement to a track-mounted carrier, while providing both suspension and easy means of adjusting cable tension.

The various embodiments described by the present specification are described in greater detail below.

SUMMARY OF INVENTION

One advantage of the present disclosure is to provide a track-mounted target carrier system, equipped with means for suspension and for adjusting cable tension. Another advantage of the present disclosure is to detail a means of using such a target carrier system. Still another advantage of the present disclosure is to provide a control system to ensure the proper position of the target carrier system.

The present disclosure includes different devices, systems, methods and applications which allow for suspension and quick adjustment of cable tension in a target system and are thus applications of a common inventive concept. It should be appreciated that various devices, systems, methods and applications will have some benefits and may lack other benefits which are present in different devices, systems, methods and applications described herein. Therefore, the teachings of the present disclosure and any actual or intended benefit of any embodiments should not be read into the claims unless expressly stated therein.

In some embodiments, a target carrier may include a target carrier frame, a tension bracket assembly having a suspension mechanism, and an adjustment mechanism, such as a winding shaft connected to a ratchet, the ratchet being contactable by a pawl.

In some embodiments, the target carrier may include a target carrier frame with a graduated adjustment window.

In other embodiments, the tension bracket assembly may further have a safety bolt, the safety bolt being engageable with the pawl.

In still other embodiments, the tension bracket assembly may further include a cable end clamp connected to the suspension mechanism.

In some embodiments, the cable end clamp may include friction slots.

In some embodiments, the tension bracket assembly may further include tension markers.

In other embodiments, the target carrier frame may include skeletonized cutouts.

In certain embodiments, the tension bracket assembly may further have a ratchet bracket cage, the cage fitting over the ratchet, the pawl, and the safety bolt.

In some embodiments, the ratchet bracket cage may be bolted to the tension bracket assembly. In certain other embodiments, the ratchet bracket cage may be welded or formed integrally with the tension bracket assembly.

In some embodiments, the target carrier may include winding shaft supports.

In one aspect, the winding shaft supports may include at least one winding shaft support cutout in the target carrier frame.

In another aspect, the target carrier frame may include a target clamp.

In still other embodiments, the tension markers may be placed at intervals corresponding to the amount of cable tension—for example, 20, 40, and 60 lbs.

In some aspects, the suspension mechanism may be a spring.

In other embodiments, the ratchet bracket cage may include a spring notch and a spring hole.

In still other embodiments, the target carrier may include a cable.

In some aspects, the suspension mechanism may be a piston.

Some aspects of the present disclosure teach method of installing a target carrier which may include supplying a track and a cable; threading the cable through a tension bracket assembly having at least one wheel for traveling along the track, an adjustment mechanism for holding one end of the cable and a suspension mechanism for holding the other end of the cable; attaching a first end of the cable to the adjustment mechanism and a second end of the cable to the suspension mechanism; and attaching at least a portion of a target carrier frame to the target bracket assembly so that at least one wheel on the target carrier frame engages the track.

The method may further include the target frame including at least one wheel which is disposed to rotate about a first axis and at least one wheel disposed to rotate about a second axis generally perpendicular to the first axis, and wherein the method comprises positioning the at least one wheel which is disposed to rotate about a first axis and the at least one wheel disposed to rotate about a second axis into contact with the track.

The present disclosure further teaches a method of adjusting the cable tension of a target carrier which may include: supplying a track and a cable; supplying a tension bracket assembly attached to the cable and a target carrier frame, the tension bracket assembly having an adjustment mechanism and a suspension mechanism, the suspension mechanism being visible from outside the target carrier frame so as to indicate tension on the cable; and adjusting tension on the cable without disturbing the target carrier frame.

These and other aspects of the present disclosure may be realized in various target carriers and methods of use as shown and described in the following figures and related description. It will be appreciated that various aspects of the invention can be used separately and that the invention is defined by the appended claims rather than this summary.

BRIEF DESCRIPTION OF DRAWINGS

Various embodiments of the present invention are shown and described in reference to the numbered drawings, wherein.

Figure 1:
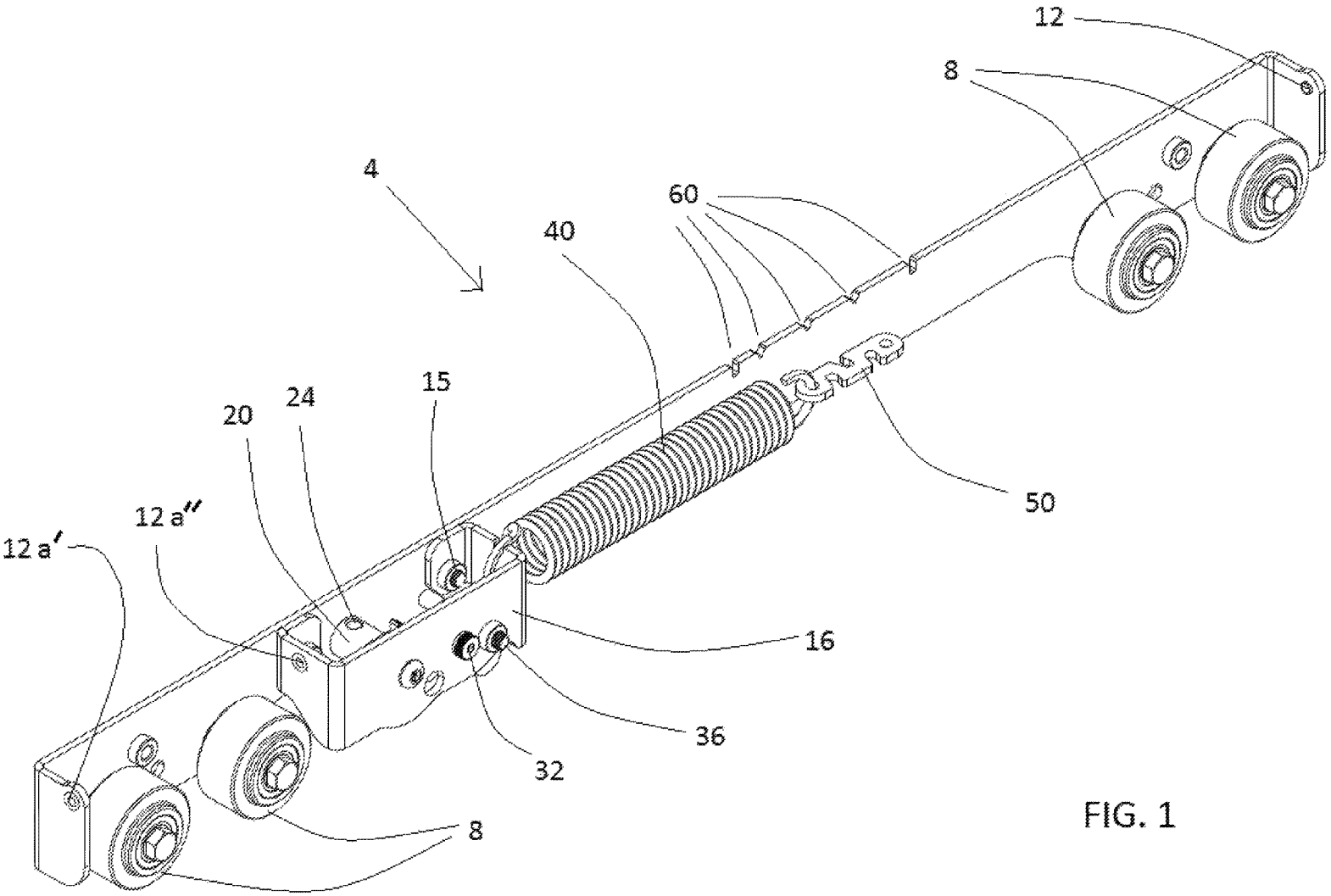
FIG. 1 shows a perspective view of an embodiment of a tension bracket assembly.

It will be appreciated that the drawings are illustrative and not limiting of the scope of the invention which is defined by the appended claims. The various elements of the invention accomplish various aspects and objects of the invention. It is appreciated that not every element of the invention can be clearly displayed in a single drawing, and as such not every drawing shows each element of the invention.

DESCRIPTION

The disclosure and accompanying drawings are discussed below, using reference numerals to identify parts and features so as to enable one skilled in the art to practice the present invention. The drawings and descriptions are exemplary of various aspects of the invention and are not intended to limit or narrow the scope of the appended claims.

Furthermore, it will be appreciated that the drawings may show aspects of the invention in isolation and the elements in one figure may be used in conjunction with elements shown in other figures. In light of the present disclosure, the skilled artisan will understand that the methods described below can be practiced without employing these specific details, or that they can be used for purposes other than those described herein. Indeed, they can be modified and can be used in conjunction with products and techniques known to those of skill in the art in light of the present disclosure.

Reference in the specification to "one configuration," "one embodiment" "one aspect" or "a configuration," "an embodiment" or "an aspect" means that a particular feature, structure, or characteristic described in connection with the configuration may be included in at least one configuration and not that any particular configuration is required to have a particular feature, structure or characteristic described herein unless set forth in the claim. The appearances of the phrase "in one configuration" or similar phrases in various places in the specification are not necessarily all referring to the same configuration, and may not necessarily limit the inclusion of a particular element of the invention to a single configuration, rather the element may be included in other or all configurations discussed herein. Thus, it will be appreciated that the claims are not intended to be limited by the representative configurations shown herein. Rather, the various representative configurations are merely representative examples and are provided to help one of ordinary skill in the art to practice the inventive concepts claimed herein.

Furthermore, the described features, structures, steps or characteristics of embodiments or aspects of the invention may be combined in any suitable manner in one or more embodiments. In the following description, numerous specific details are provided, such as examples of products or manufacturing techniques that may be used, to provide a thorough understanding of embodiments of the invention. One skilled in the relevant art will recognize, however, that embodiments of the invention may be practiced without one or more of the specific details, or with other methods, components, materials, and so forth. In other instances, well-known structures, materials, or operations are not shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect must be present apart from an express inclusion of the aspect in the claims.

It should also be noted that, as used in this specification and the appended claims, singular forms such as "a," "an," and "the" may include the plural unless the context clearly dictates otherwise. Thus, for example, reference to "a spring" may include one or more of such springs, and reference to "the layer" may include reference to one or more of such layers.

As used herein, the term "substantially" or "generally" refers to the complete or nearly complete extent or degree of an action, characteristic, property, state, structure, item, or result to function as indicated. For example, an object that is "substantially" enclosed would mean that the object is either completely enclosed or nearly completely enclosed. Likewise, a reference that something is generally perpendicular would mean that the object is sufficiently perpendicular to carry out a particular function. The exact allowable degree of deviation from absolute completeness may in some cases depend on the specific context, such that an enclosure encircling nearly all of a wheel would be substantially enclosing, even if one side of the enclosure had a slit or channel formed along a portion thereof. The use of "substantially" and "generally" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The invention and accompanying drawings will now be discussed in reference to the numerals provided therein so as to enable one skilled in the art to practice the present invention. The drawings and descriptions are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

With reference to FIG. 1, there is shown a perspective view of one embodiment of a tension bracket assembly, generally indicated at 4. The tension bracket assembly 4 may be mounted on top or on the bottom of a track, rail, or guide (not shown) along which the tension bracket assembly 4 will run. The pictured embodiment of the tension bracket assembly 4 includes one or more wheels or sliders 8 to permit easy travel of the tension bracket assembly 4 along the length of a track. A pair of wheels 8 on either end of the tension bracket assembly 4 permits for smoother motion, increased support, and greater stability of the tension bracket assembly 4 as it moves along the track, but it will be appreciated that a single wheel at each end may be used, or a wheel and a slider or electrical brush, or other means known to one of skill in the art for stabilizing a moving unit.

Also shown in FIG. 1 are bushings 12, through which the drive cable (not shown) is threaded. Bushings may be formed of a copper and tin (brass) mixture impregnated with oils, so as to form a self-lubricating channel or guide. Thus, a drive cable threaded through such bushings may experience less wear. It will be appreciated, however, that the bushings 12 may be any opening, gap, or notch through which a cable can be threaded. It is advantageous if the bushings 12 are located with sufficient clearance above the wheels 8 so that the wheels 8 do not engage or rub against the drive cable.

In the present embodiment, the bushings 12*a* located closer to the winding side or rear of the tension bracket assembly 4, near an attachment mechanism, such as a ratchet bracket assembly 16, are not co-linear. This is because, in this embodiment, a cable (not shown) threads through the bushings 12*a* and may be tied at, or extend through, the winding shaft or spool hole 24. Thus, as the winding shaft or spool 20 is rotated, the cable is gradually wrapped around the spool 20. The slightly-offset placement of the bushings 12*a* places the cable in an optimum location for even wrapping over the surface of the spool 20. The offset placement of the hole in the spool 20 creates an angle on the cable that will prevent the cable from winding in a single location. Bushing 12*a*' is positioned for optimal location for the cable relative to the motor pulleys and cable management system. Bushing 12*a*" locates the cable in optimal position for winding.

It will be appreciated that the spool 20 may be a smooth surface, or may be threaded or otherwise grooved to encourage even wrapping of the cable across the length of the spool 20. In some embodiments, the cable may be attached to the spool 20 by tying, by wrapping several times, by clipping the cable in place, or by other means known to one of skill in the art, without need for a winding shaft hole 24.

Also shown in FIG. 1 is one embodiment of an attachment mechanism for receiving a one end of the cable may include ratchet mechanism held by ratchet bracket 16. The ratchet bracket may be a generally C-shaped or cage-shaped housing. The ratchet bracket 16 may be bolted to the tension bracket assembly 4 with anchoring bolts 15 or other fasteners, or may be welded, formed integrally or otherwise affixed to with the tension bracket assembly 4. The ratchet bracket 16 may hold a ratcheting winding shaft or spool 20, a safety bolt 32, and a pawl, here indicated by a pawl bolt 36. The ratcheting spool 20 is equipped with a user-accessible ratchet access or winding nut 28, such as a 7/16" socket wrench bolt. When a person maintaining the bracket wishes to increase cable tension, he or she may remove the safety bolt 32, fit a wrench or other access tool through or around the winding nut, bar, or extension 28, and turn the winding shaft 20 so that the cable wraps around the winding shaft 20 until the desired tension is reached.

The ratchet bracket 16 may further provide an attachment point (not labeled for clarity) for a cushioning or suspension mechanism 40, such as a spring or other biasing or damping element.

As shown in FIG. 1, suspension mechanism 40 is a spring, though a rubber or other elastomeric material could also be used. The suspension mechanism 40 may additionally be a negative-pressure piston, a slider, or other means known to one of skill in the art of providing resistance or give when pulled on. In use, one end of the cable is threaded through bushing 12, and attached to a cable end clamp 50 connected to the suspension mechanism 40.

The cable end clamp 50 may advantageously include several friction notches or friction holes (labeled and described more fully below), but it will be appreciated that the cable end clamp may also be a clip, a tension clamp, a ring through which the cable may be tied or crimped, or other similar structure.

Thus, in use, one end of the cable is threaded through a bushing 12 and the cable end clamp 50, while the remaining length of cable travels the length of the track, passes through a motor or idler pulley (not pictured), and returns to pass through the ratchet-side bushings 12*a*, and then attach to the winding shaft 20. When the winding shaft 20 is tightened, the cable wraps around it, pulling the bulk of the tension bracket assembly 4 in one direction, while stretching out the cushioning mechanism or spring 40.

The final tension of the cable can be measured by use of the tension markers or tension notches 60, which preferably indicate both the relaxed position of the spring 40, and the maximum extension of the spring 40. In the present embodiment, these two positions are indicated by square-cut tension notches 60, though other markings may be used. When the spring or suspension assembly 40 is tightened to 20 lbs of tension, the first coil of the spring 40, or some other reference location, passes the first notch; at 40 lbs the second notch is reached, and at 60 lbs the first coil of the spring 40 aligns with the third notch. It will be appreciated that the placement of notches may be adjusted to match the particular type of suspension mechanism 40 being employed. The notches 60 may also be placed at intervals other than 20, 40, and 60 lbs as required by the particular application, but in many embodiments will provide for measuring tension between about 20 and 80 lbs. When very heavy targets are being moved, for example, a stiffer suspension mechanism 40 and a greater cable tension may be required, and thus the tension notches 60 may be placed to indicate cable tension of 50, 100, and 150 lbs.

It will be appreciated that in some embodiments in which the suspension or cushioning assembly 40 is not a spring, but is rather a piston, sliders, stretchable material, or other means for providing resistance known to one of skill in the art, another marker other than a coil of the spring is matched to the notches 60. For example, raised or painted lines may be placed on the outer sheath of a piston, so that when the piston is extended to 20 lbs resistance, the appropriate raised or painted line aligns with the 20 lb notch 60, and so on.

The pictured embodiment also enables a user to quickly and easily free the cable entirely from the tension bracket assembly 4, in situations when the entire cable must be replaced or the like. In order to release the cable, a user need only remove the safety bolt 32, allow the winding spool 20 to unravel until cable tension is eliminated, and then disengage the cable from the cable end clamp 50.

Figure 2:
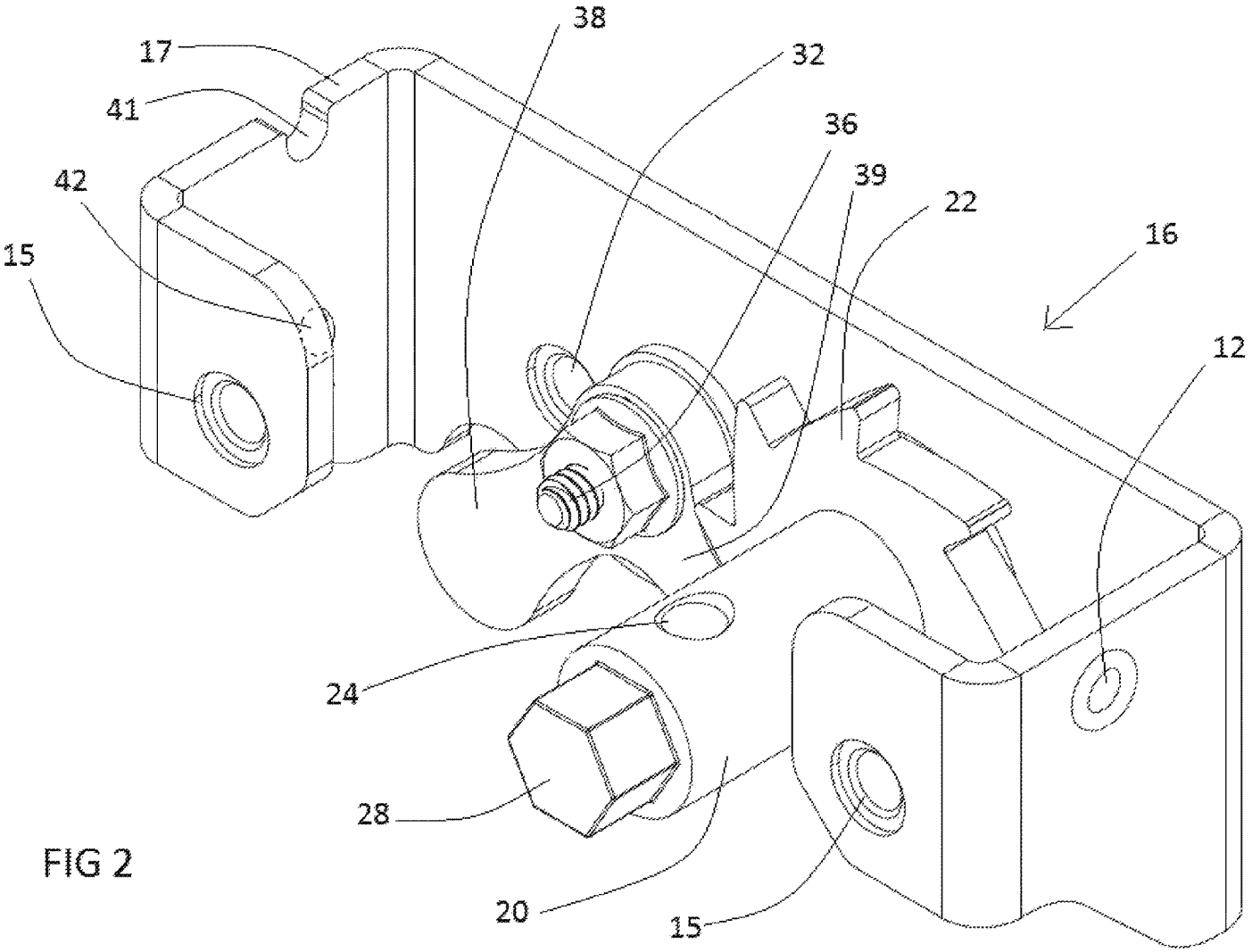
FIG. 2 shows a front view of a ratchet bracket assembly.

Turning now to FIG. 2, there is shown in more detail the internal features of the ratchet bracket 16 of FIG. 1. The ratchet bracket, generally indicated at 16, is adapted to be attached to the side of the tension bracket assembly (4 of FIG. 1, not shown in FIG. 2). In the present embodiment openings 15 which receive anchoring bolts or some other fastener can be used to allow the ratchet bracket 16 to be attached to the tension bracket assembly 4 (FIG. 1). This dual-part construction has the advantage of reducing manufacturing and installation costs. It will be appreciated, however, that the ratchet bracket 16 may instead be welded or formed integrally with, or otherwise attached to the tension bracket assembly 4 (FIG. 1).

In the pictured embodiment, a cable (not shown for clarity) passes through a brass bushing 12 and attaches to the winding spool 20 by means of a spool hole 24. The spooling hole 24 may extend all the way through the thickness of the winding spool 20, so that the cable may be fed through and tied, crimped with a fastener, etc., for a stable attachment. The spool shaft 20 can be turned by using the ratchet nut 28, which extends sufficiently far enough beyond the perimeter of the ratchet bracket 16 that it can be accessed via a cutout in the target carrier frame 100 (FIG. 5), or from the back side of the tension bracket assembly 4 (FIG. 1). The winding spool 20 is supported by a cutout in the tension bracket assembly 4 (FIG. 1) which allows it to handle higher tension on the cable without binding.

It would be possible to design the system to allow the winding to be reversible, but such in not shown in the present figure. The tension bracket assembly 4 (FIG. 1), however, is reversibly mountable. This can be accomplished by mounting the tension bracket assembly 4 (FIG. 1) in the top of the target carrier frame 100*a* (FIG. 5) or in the bottom of the target carrier frame. When installed in the bottom of the target carrier frame, the entire target carrier can be inverted so that it can be installed in a ceiling mounted track with the target hanging below the target carrier. Thus, the tension bracket assembly and remainder of the trolley can be used for both ground/floor based targets, such as a running man, and ceiling based targets, such as a runner or a retriever.

The pictured embodiment also includes a pawl toggle, latch, or trigger 38, rotatably connected to the pawl bolt 36, and accessible by either a cutout in the ratchet bracket 16 or the tension bracket assembly 4 (FIG. 1). The movement of the pawl trigger may be interrupted by a safety pin or bolt (indicated by the opening for the safety bolt 32.) When the safety bolt 32 is removed, as shown in FIG. 2, the trigger can be engaged by hand or with a pen, screwdriver, or other tool. Doing so releases the pawl stopper 39 from the teeth of the ratchet mechanism 22, allowing the winding shaft 20 to be turned freely.

The pawl stopper 39 may be springedly biased against the teeth of the ratchet mechanism 22, so that a user may tighten the winding shaft 20, but not loosen it (unless the pawl trigger 38 is moved first.) In the present embodiment, the bulbous shape of the trigger 38 not only makes it easily locatable to be turned by hand, but also gives it enough mass to cause the pawl to engage the ratchet mechanism 22 by gravity, without the use of springs or other means of biasing the pawl against the ratchet. The pawl is held in this position as gravity will reset the mechanism.

In alternate configurations, a user may swivel the pawl trigger 38 upwards, covering the hole for the safety bolt 32 and entirely disengaging the pawl stopper 39 from the ratchet teeth 22.

When the pawl stopper 39 is fully settled between the teeth of the ratchet mechanism 22, the pawl trigger 38 swivels down far enough to expose the hole for the safety bolt 32. When a safety bolt 32 is inserted, the pawl toggle 38 can no longer be triggered (by accident, for example.) Similarly, if the safety bolt cannot be easily inserted, the pawl trigger 38 may still be swiveled a little too far, indicating that the pawl stopper 39 is not yet fully settled between the teeth of the ratchet mechanism 22, which could lead to undesirable slippage of the cable tension. Such a situation can be remedied by slightly tightening or loosening the winding shaft 20, and the gravity-biased mechanism should engage the pawl with the ratchet as the winding shaft is turned slightly.

Further, in embodiments in which the pawl 36 is biased against the ratchet 22, it will be appreciated that once the safety pin or bolt mountable in opening 32 is removed the winding shaft 20 can be engaged to wind the cable tighter without first triggering the pawl toggle 38. Thus, the cable may be wound tighter—by engaging the winding nut, protrusion, or bar 28 with a tool such as a socket wrench—but cannot be loosened if the pawl trigger 38 is engaged.

It will be appreciated that one of skill in the art may select one from among many possible pawl and ratchet combinations. For example, in applications in which a very fine degree of cable tension adjustment is required, a smooth, toothless ratchet with a high friction surface such as rubber may be used. The pawl bears against the surface at an angle so that any backward motion will cause the pawl to jam against the surface and thus prevent any further backward motion.

Also shown in FIG. 2 are the means of engaging the spring, suspension, or cushioning assembly (40, FIG. 1)—in this case, a spring notch 41 and a spring hole 42, which is partially obscured by the portion of the bracket containing opening 15. The hook of the spring (40, FIG. 1) is pulled into the ratchet bracket frame, cage, or housing 17 and the end of the hook placed into spring hole 42. The base of the hook may be placed in spring notch 41, so that the spring (40, FIG. 1) does not bounce or bend out of position, even when the target carrier is brought to sudden stops or starts.

Although the pictured spring-and-hook embodiment of FIG. 2 has several advantages, such as ease of manufacture, installation, and maintenance, it will be appreciated that other means of engaging the suspension assembly (40, FIG. 1) are possible, including clips, clamps, welds, and other means known to one of skill in the art. Likewise, other means of cushioning stops and starts are contemplated by the present disclosure, such as pistons, sliders, padding, or other means known to one of skill in the art. One advantage of such a configuration, however, is that a spring may be easily replaced if it is discovered that the spring has stretched and is no longer providing the proper tensioning on the cable. If the cutouts 60 (FIG. 1) indicating relaxed and maximum extensions of the spring 40 (FIG. 1) do not line up with the notch 60, indicating relaxed position, then the spring 40 is damaged and must be replaced.

In the embodiment of FIG. 2, the cable (not pictured) threads through the bushing 12 and then passes through the winding shaft 20, which may be either smooth or textured, for example with threading so that the cable wraps evenly over the surface. The cable may be tied off and trimmed there. However, it will be appreciated that in some embodiments the cable may pass through or attach to the winding shaft 20, loop around a few times, and continue on through an optional bushing near the suspension mechanism attachment points (41 and 42, in this view.) The cable may then attach to itself, thus forming one continuous loop through the tension bracket assembly (4, FIG. 1) and any drive motors or idler pulleys which move the cable. Such a cable may still be tightened or loosened by winding the cable around the shaft 20, as detailed above. Such an embodiment may be more reliable, as it has no loose ends which could slip free, but is typically more difficult to replace.

In either case, one of skill in the art will recognize that at least a portion of the weight of the tension bracket assembly (4, FIG. 1) and any attached target carriers or targets is borne by the shaft 20. One means of addressing this concern is to support the shaft 20 at both ends.

Figure 3:
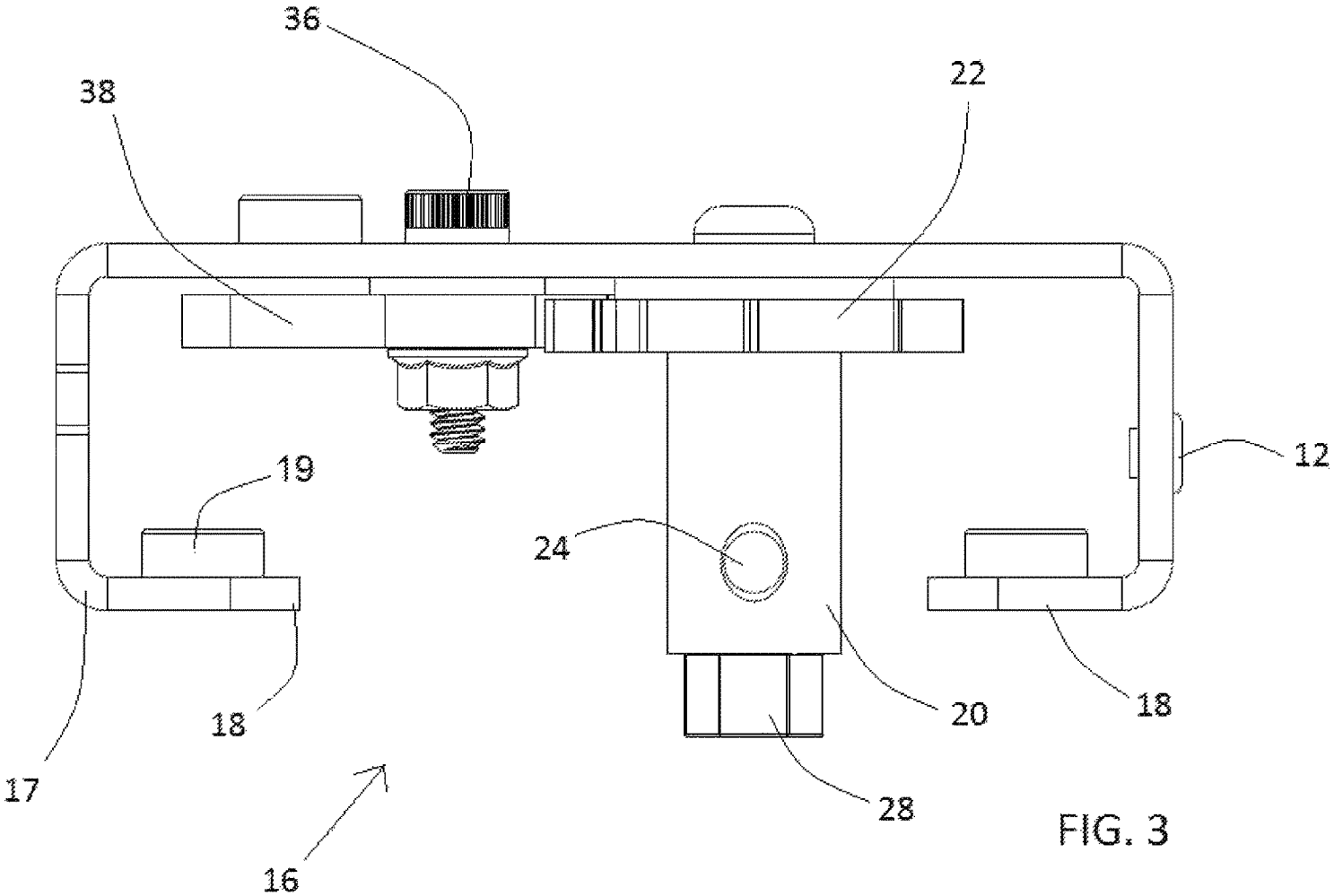
FIG. 3 shows a top view of the ratchet bracket assembly of FIG. 2.

Turning now to FIG. 3, there is shown a top view of the ratchet bracket (generally indicated at 16) of FIG. 2. As in FIG. 2, the safety bolt has been removed for clarity. Also shown are the attachment wings 18 of the ratchet bracket frame or housing 17. When the ratchet bracket 16 is installed in a tension bracket assembly (4, FIG. 1), the attachment wings 18 are pressed against, welded to, or formed integrally with the tension bracket assembly (4, FIG. 1). Nuts 19 can bed welded or otherwise attached to the interior side of the wings 18 to facilitate attachment to the tension bracket assembly.

The winding shaft 20 may be longer than the width of the ratchet bracket, extending beyond the attachment wings 18. The winding shaft 20 is thus inserted through, and supported by, a cutout in the tension bracket assembly. This feature has the advantages of providing support at both ends of the winding shaft 20, while allowing easy access to the winding nut or point 28. In such an embodiment, the weight of the tension bracket assembly (4, FIG. 1) and any attached targets is more sturdily carried. The winding shaft 20 may extend beyond the attachment wings by about 0.2-2 inches. It will be appreciated that additional support may help reduce binding as may be caused by the cable pulling against the winding shaft if the winding shaft is supported at only one end. Furthermore, other means of supporting the winding shaft 20 at both ends are contemplated, such as protrusions or extended attachment wings 18, or other means known to skill of one in the art. Moreover, when only lightweight target carriers and targets are being moved, it may not be necessary to include additional support. In contrast, then steel or much heavier targets are used, ball bearings or bushings may be required to support the winding shaft.

Figure 4:
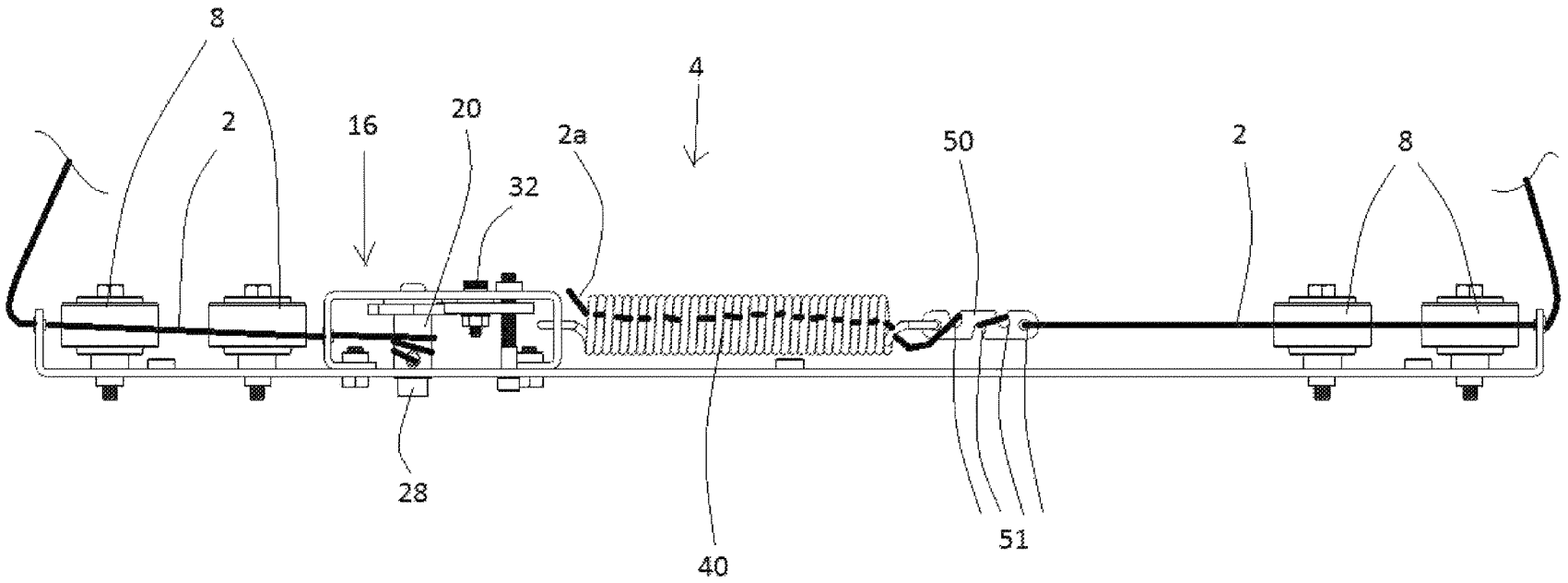
FIG. 4 shows a side view of an embodiment of a tension bracket assembly with a cable installed.

Turning now to FIG. 4, there is shown an embodiment of a tension bracket assembly, generally indicated at 4, with a ratchet bracket, generally indicated at 16, installed. Also shown is a cable 2, with one end wrapped around the winding shaft 20 of the ratchet bracket assembly 16. The second end of the cable, 2*a*, is positioned to engage with the cable end clamp 50.

In the present embodiment, the cable end clamp 50 includes several frictional resistance holes or slots 51, through which the cable end 2*a* can be threaded. The friction slots 51 may be sized to admit and hold the size of the cable in use, and may be inclined or sloped so that the cable 2 or 2*a* does not slip loose when tension is released. One particular advantage of this embodiment is that the cable end clamp 50, in conjunction with the ratcheting mechanism, eliminates the need for compression sleeves and the costly and cumbersome crimping equipment that is typically required to string a cable.

The cable 2 and 2*a* is typically formed of braided steel or other durable material, and thus can be quite stiff. Therefore, weaving the cable end 2*a* through the frictional slots or holes 51 provides a robust attachment that can be quickly and easily released, if necessary—for example, during cable replacement. By adjusting the number and degree of tilt of the slots 51, one of skill in the art can also create cable end clamp 50 that will self-release if very high pressures are applied. This may occur if, for example, a pulley becomes stuck or an obstruction is encountered on the track. Should such an event occur, it is beneficial if the cable self-releases, thus preventing range equipment such as the target carrier or motor from being damaged by excessive strain.

In ranges where cable self-release is not desirable, the cable 2 may simply be tied in place, and the loose end 2*a* looped through the friction slots 51 to prevent it from dragging. Alternately, the loose end 2*a* may be longer, and may extend leftwardly to the winding shaft 20 (incorporating some slack to account for any expansion of the spring or suspension assembly 40). In the alternative, the loose end of the cable may be tucked inside the spring as shown in FIG. 4.

The tension bracket assembly 4 may be used as a stand-alone device, and can be mounted to any trolley or carriage which is drawn by a drive cable and runs along a track. The tension bracket assembly in some embodiments is narrow in profile, so that it can be used to replace regular wheels, while simultaneously both providing suspension and a means of measuring cable tension.

A further advantage of the presently disclosed tension bracket assembly is that components of both cable tension bracket 4 and any trolley attached thereto (with the exception of parts actively engaging the cable, such as the cable end clamp 50 and the winding shaft 20) can be removed, replaced, or serviced without removing, restringing, or even untensioning the cable. This includes the wheels on the tension bracket. This is a great advantage to individuals performing servicing or maintenance, as cable replacement can be laborious and time consuming, and cables are often removed to replace components not related to cable tensioning.

Figure 5:
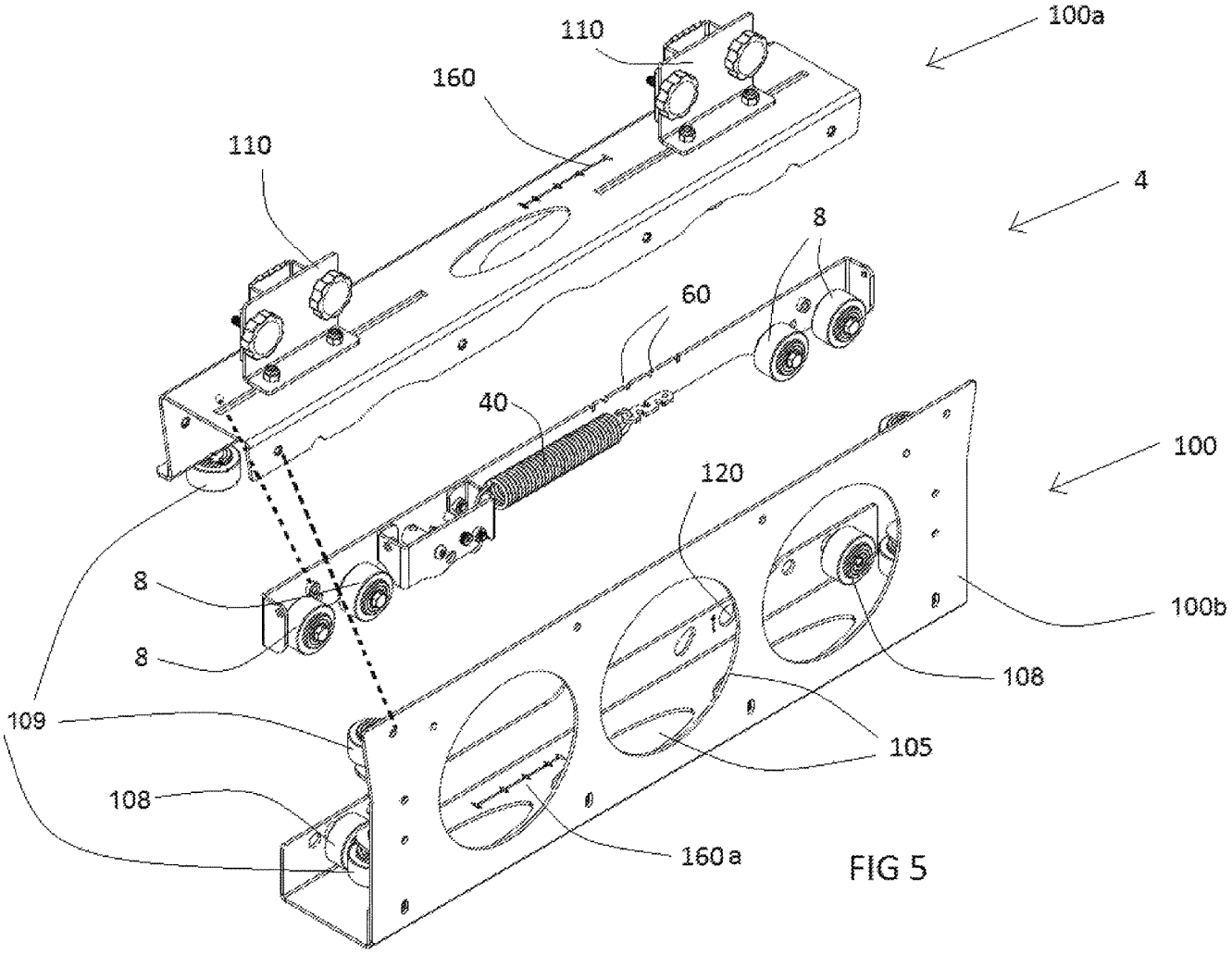
FIG. 5 shows an exploded view of the target carrier frame and the tension bracket assembly which fit together along the dotted lines.

Turning now to FIG. 5, there is shown an exploded view of one embodiment of a target carrier, which attaches together as shown by the dotted lines. (Only two lines are shown for clarity; additionally some of the connecting bolts have been omitted for clarity.) The tension bracket assembly 4 discussed in detail previously bears tension markers 60. The tension bracket assembly 4 may be removably connected to either of two halves of a target carrier frame, casing, or housing, generally indicated at 100, by as fastener such as a bolt, screw, etc. Typically, one side of the target carrier casing will include target mounts 110, which are adapted to attach to target supports of varying types and sizes. These target mounts 110 may be moveable with respect to one another, and can be positioned close together for small targets or towards one side of the target carrier.

Figure 7:
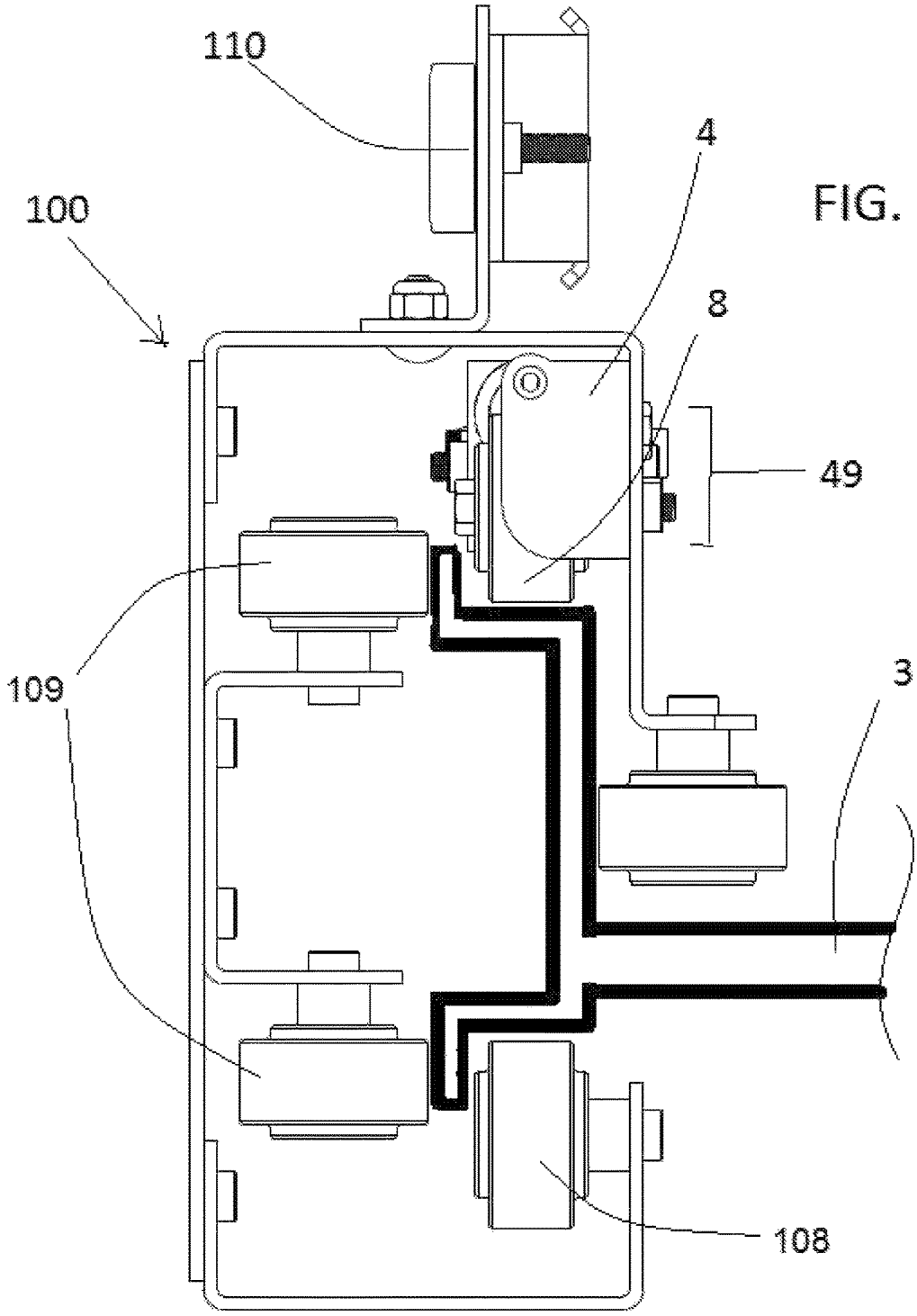
FIG. 7 shows an end-on view of a target carrier frame, with a tension bracket assembly installed, fitted to a track.

For upright installation, tension bracket assembly 4 may be installed in the first portion 100*a* of the target carrier frame 100*a*. As shown in FIG. 5, the first portion 100*a* includes the target mounts 110 for engaging the target. One or more wheels 108 are disposed in the second portion 100*b* of the carrier frame. In such an orientation, the wheels 8 of the tension bracket assembly 4 will ride on top of a track, while the wheels 108 in the second portion 100*b* ride along the bottom of the track. Additionally, one or more wheels 109, which rotate about a vertical axis, are used to help position the target carrier frame 100 on a track 3 (FIG. 7).

In this orientation, the cable (not shown) will be disposed above the track and may be supported thereby if there is slack in the cable. The cable moving above the track moves the tension bracket assembly 4, thereby moving the target carrier frame 100 and thus the target. The target bearing side or first portion 100*a* of the target carrier frame 100 is, in this embodiment, placed in an upright position, and will present targets to the shooter at a position above the target carrier (such as when the track runs along the ground.)

The target carrier may be used inverted on a ceiling-mounted track such that the target mounts 110 hang beneath the target carrier frame 100. It will be recognized, however, that the target carrier frame 100 may be flipped over without difficulty, to present the targets in a downward position (such as when the track runs above a lane). This may be accomplished by simply rotating the target carrier frame 180 degrees so that the tension bracket assembly 4 would be disposed below the track, as would the cable.

It is presently preferred, however, to maintain the cable above the track. To accomplish such in the target carrier frame 100 shown in FIG. 5, the wheels 108 would be removed and the target carrier frame 100 would be rotated 180 degrees. The tension bracket assembly 4, is the attached to second portion 100*b* of the target carrier frame 100 in the general location formerly occupied by the wheels 108, and the wheels 108 are attached in the first portion 100*a* of the target carrier frame 100 in the position formerly holding the tension bracket assembly 4. In other words, the tension bracket assembly 4 and the wheels 108 remain in the same locations as shown in FIG. 5, and the remaining structures associated with the target carrier frame 100 are rotated 180 degrees so that the target mounts 110 are now positioned on the bottom. This orientation allows the cable (not shown) to remain above the track where it is more easily controlled with a cable management system.

One or both sides of the target carrier frame 100 and 100*a* may include appropriate cutouts, such as the winding shaft support cutout 120. The target carrier frame 100 may also include one or more graduated adjustment windows or indicators 160. The graduated adjustment windows 160 may align with the tension markers 60 on the tension bracket assembly 4, and permit a user to view the extension of the spring or suspension mechanism 40. Because the cable (not shown, for clarity) connects to the suspension mechanism 40, a user can thus view a measurement of the cable tension by observing the extension of the suspension mechanism. In a more common scenario, however, the tension markers 60 are at least partially obscured by the target carrier frame 100. To this end, the extension of the suspension mechanism 40 may be viewed directly through the graduated adjustment windows 160 to determine tension and make adjustments accordingly.

If the suspension mechanism 40, as viewed through the graduated adjustment windows 160, has grown too loose, the cable may then be easily tightened as discussed previously.

As with the winding shaft support cutouts 120 and other cutouts discussed below, both portions of the target carrier frame 100 may bear graduated adjustment windows 160. For example, in the present alignment, the alternate graduated adjustment window 160*a* is not aligned with the tension markers 60 on the tension bracket assembly 4. However, if the target carrier frame 100 must be rotated during installation in order to preset the target mounts 110 in a downward manner, the tension bracket assembly 4 may likewise be rotated over. Then, the extension of the suspension mechanism 40, are viewable through the alternate graduated adjustment window 160*a*.

Finally, both portions of the target carrier frame 100 may include skeletonised cutouts, several of which are indicated at 105. These skeletonized cutouts 105 may be round, oblong, angular, or irregular holes, and reduce the mass of the target carrier frame 100 without compromising structural integrity. The skeletonized cutouts may also provide access to portions of the tension bracket assembly 4.

Figure 6:
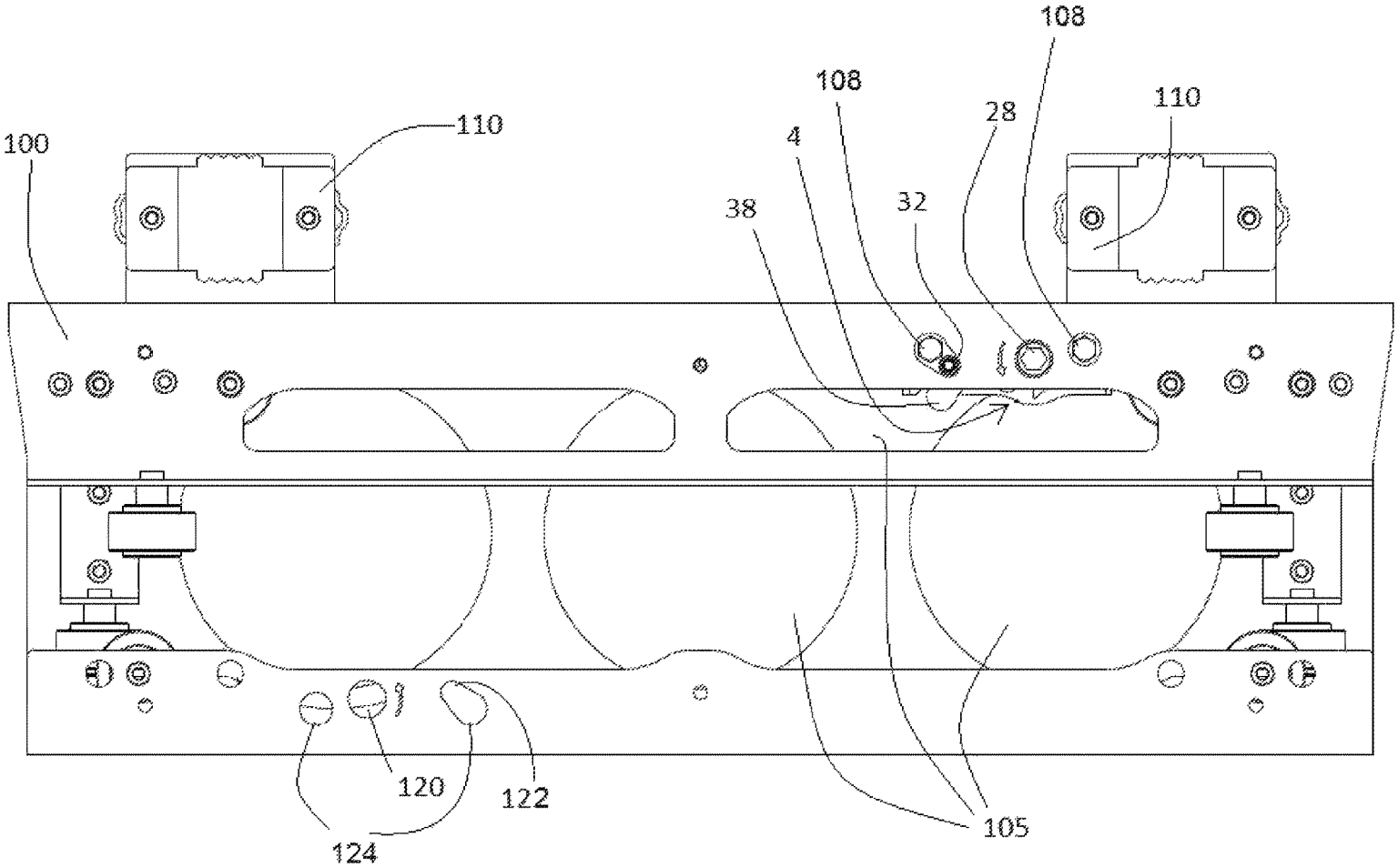
FIG. 6 shows a rear (track-side) view of a target carrier frame with the tension bracket assembly installed.

Turning now to FIG. 6, there is shown a view from the back of a fully assembled target carrier frame 100 with a tension bracket assembly (mostly obscured, but indicated generally at 4) installed. As assembled in this view, the target carrier frame 100 is ready for mounting on a track (not shown), and the target mounts are positioned to present targets above the target carrier.

Also shown are the winding shaft alternate cutout 120, the safety bolt alternate cutout 122, as well as cutouts 124 for clearance for the bolts which secure the ratchet bracket 16 to the tension bracket assembly 4. In the event that the tension bracket assembly 4 must be flipped over and installed in any of the discussed alternate configurations, these cutouts provide the necessary supports and access points.

In the present embodiment, once a cable (not shown) is threaded through the tension bracket assembly 4, the cable tension may be adjusted. First, a user may remove the safety bolt 32, releasing the pawl mechanisms. Then, a user may reach through one of the skeletonized cutouts 105 and contact the pawl toggle 38 with an elongate tool such as a screwdriver or pen, or by hand. The pawl toggle then disengages the ratchet mechanism teeth (not shown; see 22, FIG. 2). Thus disengaged, the spool or shaft (not shown; see 20, FIG. 2) can rotate freely, loosening the cable. If a user wishes to tighten the cable, the user may release the pawl toggle 38 so that the pawl stopper 39 (FIG. 2) falls back into place, and then use a wrench or other tool to tighten the ratcheting winding protrusion, nut, or access point 28. Once the cable has reached the appropriate tension (as determined by viewing through the graduated adjustment window; see FIG. 5), the user may simply replace the safety bolt 32.

Turning now to FIG. 7, there is shown a cross-sectional, cutaway, end view of a fully assembled target carrier frame or housing 100 with a tension bracket assembly 4 installed. The entire target carrier is mounted on a track 3, and is free to roll either forwards or backwards, as pulled by a driver cable (not pictured for clarity.) In the present embodiment, a target clamp 110 is mounted above the target carrier 100. In profile, the tension bracket assembly 4 may be compact, as pictured, and thus can be mounted either above the track 3 (as shown) or can replace the lower guidance wheel 108 by using the alternate cutouts as previously described, enabling the target carrier frame 100 to be mounted in an inverted orientation, with clamps 110 hanging beneath the track.

Although the present embodiment has advantages in stability and control, it will be appreciated that other layouts of wheels or tracks are likewise contemplated by the specification.

After the target carrier frame 100 is mounted on a track 3 and a cable passed through the tension bracket assembly 4, an exterior cover (not pictured) may be placed over the target carrier frame 100. The exterior cover may provide resistance against impacts by stray bullets or ricochets, and may also include appropriate cutouts to access the cable tension controls (generally indicated at 49) and the graduated viewing window (see 160, FIG. 5).

Figure 8:
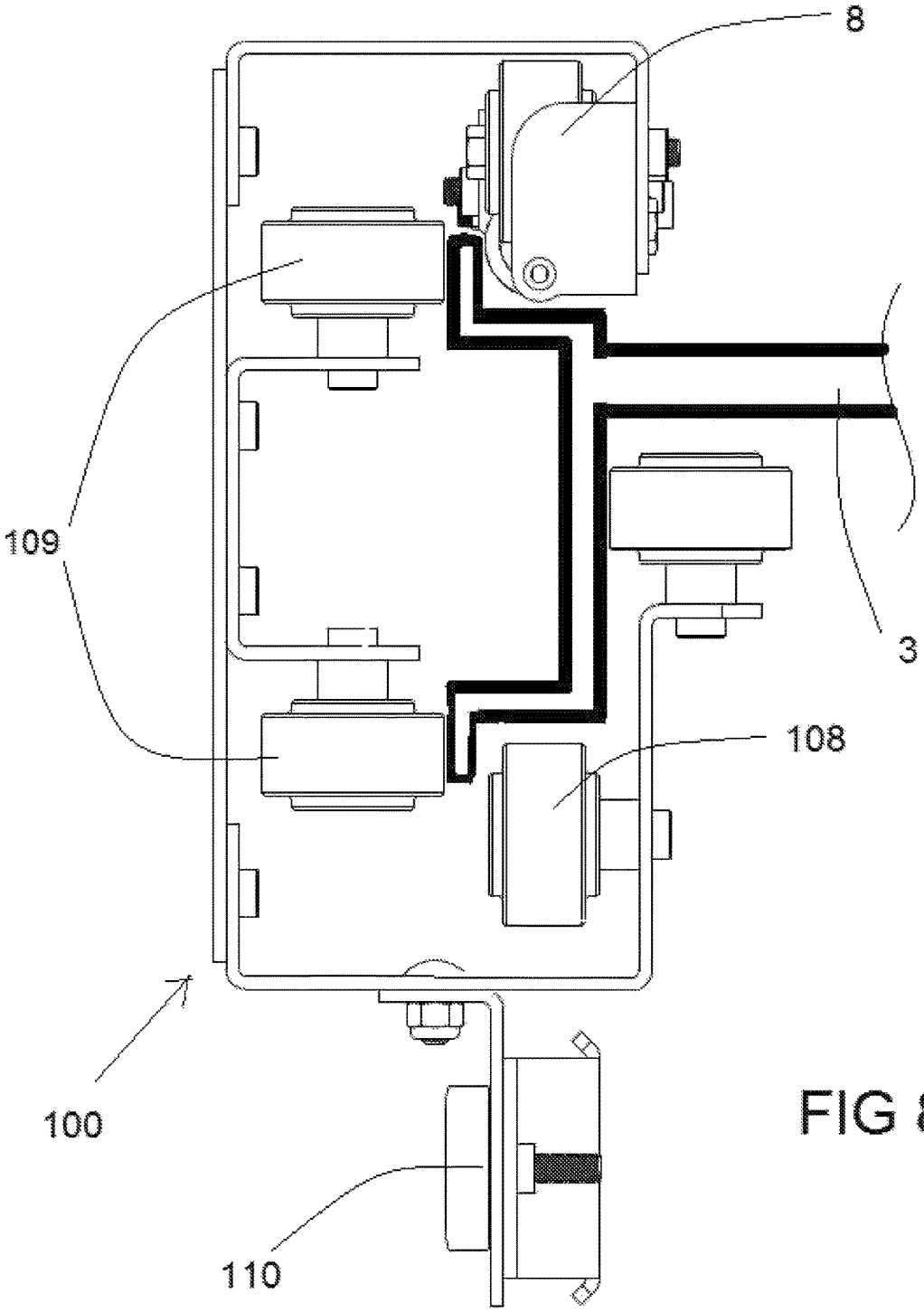
FIG. 8 shows an end view of the target carrier frame and tension bracket assembly configured for use from a ceiling mounted track.

Turning now to FIG. 8, there is shown an end view of the target carrier frame 100 which has been inverted so as to run along a ceiling hung track.

While the entire unit could be simply inverted with the tension bracket assembly traveling along the bottom of the track 3, some cable management systems are designed to be positioned above the track where the cable can be kept out of the way and less likely to be damaged. To accomplish this configuration, the tension bracket assembly 8 and the wheel(s) 108 are detached from the target carrier frame 100 and reattached with the tension bracket assembly in the location of the wheel(s) 108 and vice versa. This simply change allows the orientation of the target carrier frame 100 to be reversed while keeping the tension bracket assembly above the track. Because the tension bracket assembly is a stand-alone structure with respect to the cable, this could all be done without removing the target bracket assembly 8 from the track 3 or interfering with the tension on the cable.

Those skilled in the art will appreciate that this is a major improvement in target carrier systems. Not only can the tension bracket assembly 8 be adjusted without removing all or part of the target carrier frame, a damaged target carrier frame can be completely replaced without affecting the tension on the cable.

Figure 9:
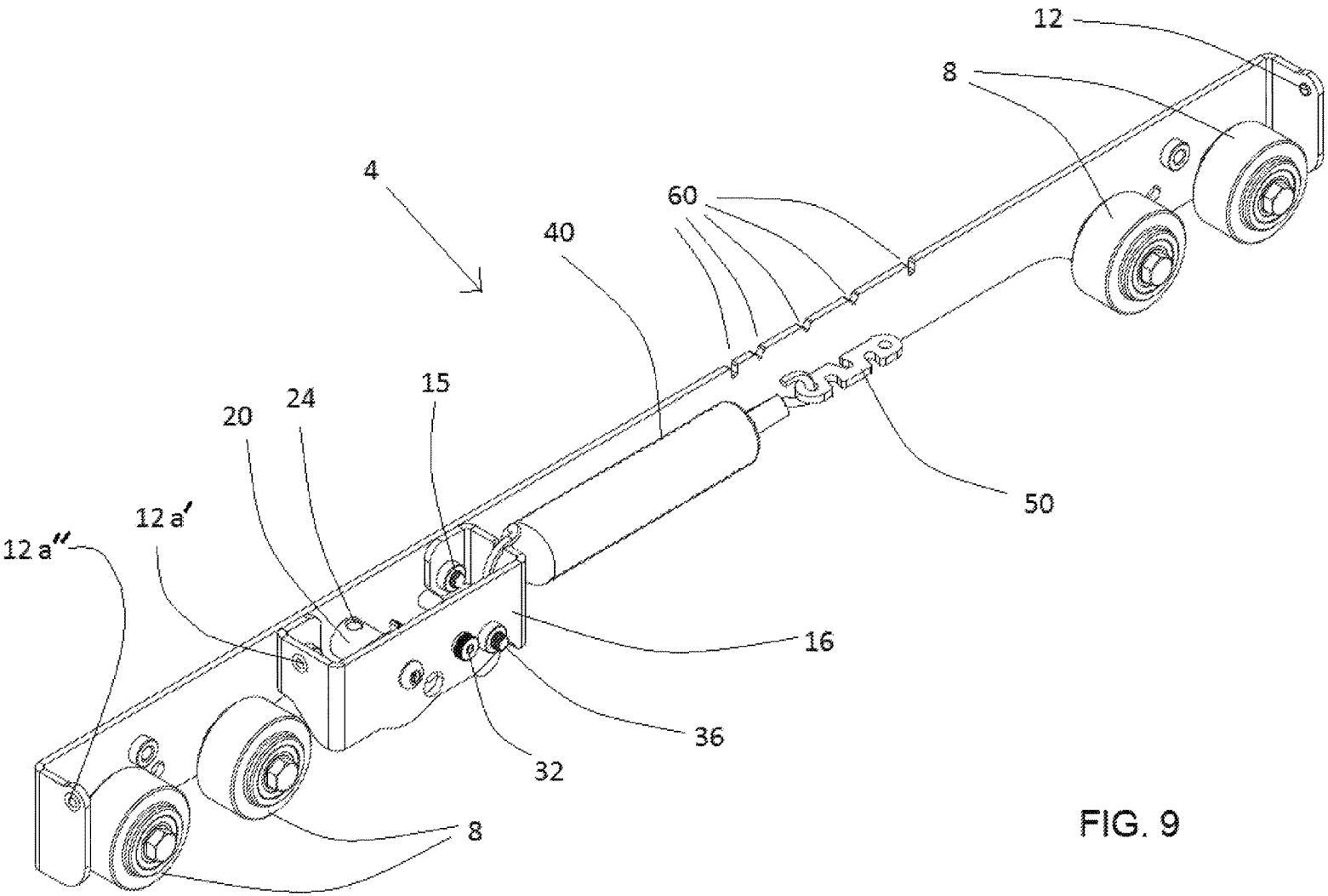
FIG. 9 shows a view similar to that of FIG. 1 with an alternate suspension mechanism.

Turning now to FIG. 9, wherein is shown a perspective view of tension bracket assembly 208 which is substantially the same as that in FIG. 1 and is marked accordingly. One difference, however, is that the suspension mechanism 40 is in the form of a piston rather than a spring.

It will be appreciated that the present disclosure teaches multiple innovative aspects which may be used together in various combinations. For example, the present disclosure teaches a target carrier which has and a tension bracket having a suspension mechanism and a winding shaft connected to a ratchet, the ratchet being engageable by a pawl. The target carrier may further include: a target carrier frame, which may have a graduated adjustment window; a safety bolt, the safety bolt being engageable with the pawl; a cable end clamp connected to the suspension mechanism; a cable end clamp which includes friction slots; tension markers; a target carrier frame with skeletonized cutouts; a ratchet bracket cage, the cage fitting over the ratchet, the pawl, and the safety bolt; ratchet bracket cage being bolted to the tension bracket assembly; winding shaft supports; winding shaft supports which include at least one winding shaft support cutout in the target carrier frame; a target clamp; tension markers placed at intervals corresponding to 20, 40, and 60 lbs of pressure; a suspension mechanism in the form of a spring; a ratchet bracket cage having a spring notch and a spring hole; a cable; and/or suspension mechanism in the form of piston, or combinations thereof.

Likewise, the disclosure teaches methods, such as method of installing a target carrier including, supplying a track and a cable, threading the cable through a tension bracket having a ratchet, a pawl, a suspension mechanism, and a winding shaft, attaching a first end of the cable to the winding shaft; turning the winding shaft; engaging the winding shaft with the pawl; and attaching a second end of the cable to the suspension mechanism. Similarly, a method of adjusting the cable tension of a target carrier may include supplying a track and a cable, supplying a tension bracket having a ratchet, a pawl engaged with the ratchet, a winding shaft connected to with the ratchet, and a suspension mechanism, the winding shaft and suspension mechanism being engaged with the cable, disengaging the pawl from the ratchet, adjusting the winding shaft; and engaging the pawl with the ratchet.

Those skilled in the art will recognize various modifications which could be made to the embodiments disclosed herein without departing from the scope and spirit of the invention. The following claims are intended to cover such modifications.

The invention claimed is:

1. A target tension system comprising:

a tension bracket assembly configured for attachment to a cable, the tension bracket assembly having a suspension mechanism and at least one tension marking disposed adjacent the suspension mechanism for determining the tension on the cable when the cable is attached to the suspension mechanism;

a ratchet bracket assembly attached to or formed integrally with the tension bracket, the ratchet bracket having a ratchet and a winding spool for adjustably receiving an end portion of the cable;

a target carrier frame releasably attachable to the tension bracket assembly, and target mounts being attached to or formed integrally with the target carrier frame; and the cable attached to the suspension mechanism wherein the target carrier frame can be removed from the tension bracket assembly without changing the tension on the cable provided by the suspension mechanism.

2. The target tension system of claim 1, further comprising an adjustment mechanism for adjusting tension on the cable, and wherein the target carrier frame includes at least one open portion such that the adjustment mechanism can be adjusted without any disassembly of the target carrier frame.

3. The target tension system of claim 1, wherein the target carrier frame has a graduated adjustment window to enable determination of the tension on the cable.

4. The target tension system of claim 3, wherein the tension bracket assembly further comprises a cable end clamp connected to the suspension mechanism.

5. The target tension system of claim 1, wherein the tension bracket assembly further comprises tension markers for indicating tension on the cable.

6. The target tension system of claim 5, wherein the tension markers are placed at intervals corresponding to 20, 40, and 60 lbs of pressure.

7. The target tension system of claim 1, wherein the target carrier frame comprises skeletonized cutouts.

8. The target tension system of claim 1, further comprising target mounts extending from the target carrier frame.

9. The target tension system of claim 1, wherein the suspension mechanism comprises a spring.

10. The target tension system of claim 1, wherein the suspension mechanism is a piston.

11. A target tension system comprising:

a tension bracket assembly configured for attachment to a cable, the tension bracket assembly having a suspension mechanism and at least one tension marking disposed adjacent the suspension mechanism for determining the tension on the cable when the cable is attached to the suspension mechanism;

target mounts attached to the tension bracket assembly;

a target carrier frame releasably attachable to the tension bracket assembly, the target mounts being attached to or formed integrally with the target carrier frame; and wherein the tension bracket assembly is mountable in the target carrier frame in a first position such that the tension bracket assembly is disposed in an upper portion of the target carrier frame with the target mounts disposed above the tension bracket assembly, and a second position such that the tension bracket assembly is disposed in an upper portion of the target carrier frame and the target mounts are disposed below the tension bracket assembly.

12. The target tension system of claim 11, further comprising at least one wheel removably attached to the target carrier frame in a portion generally opposite from the tension bracket assembly.

13. The target tension system of claim 12, wherein the tension bracket assembly comprises at least one wheel disposed to rotate about a horizontal axis and wherein the at least one wheel removably attached to the target carrier frame is disposed to rotate about a horizontal axis.

14. The target tension system of claim 12, wherein the target carrier frame includes at least one wheel disposed to rotate about a generally vertical axis.

15. A system for carrying a target comprising the target tension system the system comprising:

a target tension system comprising:

a tension bracket assembly configured for attachment to a cable, the tension bracket assembly having a suspension mechanism and at least one tension marking disposed adjacent the suspension mechanism for determining the tension on the cable when a cable is attached to the suspension mechanism;

a ratchet bracket attached to or formed integrally with the tension bracket, the ratchet bracket having a ratchet and a winding spool for adjustably receiving an end portion of the cable;

target mounts attached to the tension bracket assembly; and, a target carrier frame releasably attachable to the tension bracket assembly, the target mounts being attached to or formed integrally with the target carrier frame;

a track, the tension bracket assembly being disposed to run along the track, and a cable for driving the tension bracket assembly along the track.

16. The system for carrying a target of claim 15, wherein the tension bracket assembly comprises at least one wheel that runs along the track, and wherein the target carrier frame has at least one wheel disposed in the same orientation as the at least one wheel of the tension bracket assembly and at least one wheel disposed generally perpendicular to the at least one wheel of the tension bracket assembly.

17. A target tension system comprising:

a tension bracket assembly configured for attachment to a cable, the tension bracket assembly having a suspension mechanism and at least one tension marking disposed adjacent the suspension mechanism for determining the tension on the cable when the cable is attached to the suspension mechanism and a cable end clamp connected to the suspension mechanism, the cable end clamp comprising friction slots;

a ratchet bracket attached to or formed integrally with the tension bracket, the ratchet bracket having a ratchet and a winding spool for adjustably receiving an end portion of the cable;

target mounts attached to the tension bracket assembly;

a target carrier frame releasably attachable to the tension bracket assembly, the target mounts being attached to or formed integrally with the target carrier frame; and a cable and wherein the target carrier frame has a graduated adjustment window to enable determination of the tension on the cable.

18. A target tension system comprising:

a tension bracket assembly adapted to be attached to a cable, the tension bracket assembly having a suspension mechanism and at least one tension marking disposed adjacent the suspension mechanism for determining the tension on the cable when the cable is attached to the suspension mechanism, and a plurality of wheels; and the cable attached to the tension bracket assembly, the cable having a first end attached to the tension bracket assembly and a second end attached to the suspension mechanism.

19. The target tension system of claim 18, wherein the tension bracket assembly comprises an adjustment mechanism and wherein the first end of the cable is attached to the adjustment mechanism.

20. The target tension system of claim 19, further comprising a target carrier frame attached to the tension bracket assembly, the target carrier frame having at least one open portion such that the adjustment mechanism can be adjusted without any disassembly of the target carrier frame.

21. The target tension system of claim 20, wherein the target carrier frame can be removed from the tension bracket assembly without changing tension on the cable.

22. A target tension system comprising:

a tension bracket assembly configured for attachment to a cable, the tension bracket assembly having a suspension mechanism and at least one tension marking disposed adjacent the suspension mechanism for determining the tension on the cable when the cable is attached to the suspension mechanism wherein the tension bracket assembly includes a plurality of wheels, the wheels being disposed on opposing ends such that when the cable is attached to the tension bracket assembly, the cable passes adjacent to and over the plurality of wheels; and a ratchet bracket assembly attached to or formed integrally with the tension bracket, the ratchet bracket having a ratchet and a winding spool for adjustably receiving an end portion of the cable.

23. A target tension system comprising:

a tension bracket assembly adapted to be attached to a cable, the tension bracket assembly having a suspension mechanism and at least one tension marking disposed adjacent the suspension mechanism for determining the tension on the cable when the cable is attached to the suspension mechanism, and a plurality of wheels; and the cable attached to the tension bracket assembly, the cable having a first end attached to the tension bracket assembly and a second end attached to the suspension mechanism; and a target carrier frame releasably attached to the tension bracket assembly wherein the target carrier frame can be removed from the tension bracket assembly without changing tension on the cable; and wherein the target carrier frame can be removed from the tension bracket assembly without changing tension on the cable.

24. The target tension system of claim 23, further comprising an adjustment mechanism for adjusting tension on the cable, and wherein the target carrier frame has at least one open portion such that the adjustment mechanism can be adjusted without any disassembly of the target carrier frame.

25. The target tension system of claim 23, wherein the tension bracket assembly comprises a plurality of wheels and wherein the first end of the cable and the second end of the cable are connected to the tension bracket assembly between the plurality of wheels.

26. The target tension system of claim 23, further comprising a ratchet bracket attached or to formed integrally with the tension bracket assembly, and a ratchet and winding spool attached to the ratchet bracket.

* * * * *